US005135074A

United States Patent [19]

Hornagold

[11] Patent Number: 5,135,074

[45] Date of Patent: Aug. 4, 1992

[54] TELESCOPIC BOOM ELEVATING APPARATUS WITH A MECHANICAL LIFT AND LEVEL LINKAGE SYSTEM

[75] Inventor: John T. Hornagold, Brown Deer, Wis.

[73] Assignee: Simon Aerials Inc., Milwaukee, Wis.

[21] Appl. No.: 723,443

[22] Filed: Jun. 27, 1991

[51] Int. Cl.[5] ..... B66F 11/04; B66B 9/20

[52] U.S. Cl. ..... 182/2; 182/63; 182/141; 187/9 R

[58] Field of Search ..... 182/2, 63, 141, 148; 187/9 R

[56] References Cited

U.S. PATENT DOCUMENTS

| | | | |
|---|---|---|---|
| 3,893,540 | 7/1975 | Beucher | 182/2 |
| 4,162,873 | 7/1979 | Smith | 182/2 |
| 4,326,601 | 4/1982 | Grove | 182/2 |
| 4,694,930 | 9/1987 | Kishi | 182/2 |
| 4,741,413 | 5/1988 | Kishi | 187/9 R |
| 4,754,840 | 7/1988 | MacDonald | 182/2 |
| 4,775,029 | 10/1988 | MacDonald | 182/2 |
| 4,953,666 | 9/1990 | Riding | 182/2 |

*Primary Examiner*—Reinaldo P. Machado

*Attorney, Agent, or Firm*—Andrus, Sceales, Starke & Sawall

[57] ABSTRACT

A telescopic boom and lift apparatus positions a vertical support and platform and includes a telescopic boom unit and a rigid mechanical lift linkage to pivot the boom unit with automatic leveling of the support. The telescopic boom unit is pivoted to a base, with a motor unit coupled to extend and retract the boom unit. A rigid linkage unit is pivotally interconnected to the base and the tip boom of the boom unit. The linkage unit is constructed and arranged to support the boom unit in the retracted, collapsed position and to exert a lifting and pivot force on the boom unit in response to extension of the tip boom. Parallelogram linkages on the boom unit and lift unit are coupled to a pivot unit at the tip boom and maintains a precise orientation of the vertical support and platform. The lift arm unit includes parallel rigid arms which are laterally spaced such that the boom unit collapses into the lift unit to form a compact assembly. The wide spacing of the pivot support for the boom unit and lift unit creates a stable support permitting angular positioning of the platform on the vertical support.

24 Claims, 5 Drawing Sheets

TELESCOPIC BOOM ELEVATING APPARATUS WITH A MECHANICAL LIFT AND LEVEL LINKAGE SYSTEM

BACKGROUND OF THE INVENTION

This invention relates to a telescope apparatus for elevated orientation of a working platform or other operating or support structure.

Lift devices are widely used for locating of personnel in raised work areas in both industrial, institutional, municipal applications. Generally, such devices include a mobile support structure for moving of the device to the area of work. An elevating mechanism is mounted on the support with a work platform supported thereby. The lift mechanism usually includes various mechanically collapsible mechanisms and powered positioning motor means. For transport, the mechanism is collapsed to locate the mechanism and platform on the base support for convenient and reliable transport. At the work area, the lift mechanism is actuated to raise the platform to the elevated work area. Various mechanisms have been developed and are commercially used in commerce. Typically, such mechanisms use various scissors mechanism with multiple linkages, a plurality of individual articulated boom members connected for successive alternate angular extensions and collapsing and the like. In addition, a telescopic boom unit provides a convenient and reliable mechanism in a lift device for many applications. The telescopic boom unit is formed with a base member pivotally mounted to the support unit and one or more outer telescopic members. A motor means is coupled to the telescopic section for extending and retracting the telescopic boom unit. The platform is pivotally secured to the outermost tip boom member, and may be secured with one or more articulated boom members secured between the platform and telescopic boom unit. In the transport or storage position, the telescopic boom unit is collapsed and pivoted onto the base support unit. In a lift or raised position the boom unit is pivoted upwardly, generally with a slight angle to the vertical and the telescopic boom extended. In the various systems, the motor means are separate hydraulic cylinder units for pivoting the boom unit and for expanding and contracting the telescopic members in a controlled manner for smooth, reliable positioning of the platform or other work support structure. Thus, separate hydraulic cylinder units are provided for collapsing the platform to the transport position and for locating and maintaining the platform in appropriate horizontal orientation in the raised position.

In telescopic boom and other articulated boom apparatus, the horizontal orientation of the platform will vary with the angular orientation of the boom unit because of the pivotal mounting of the platform to the tip of the boom and for complete collapse of the unit in the lowered position. The separate hydraulic cylinder unit or units may be provided between the tip boom member and the platform support for establishing and maintaining precise location of the platform for safe operating usage by the supported personnel. In systems using articulated boom members, a vertical post at the articulated connection is desirable to maintain the orientation of the boom members. An additional cylinder unit may be used to control the vertical orientation of the vertical post. Typical telescopic boom units are shown in U.S. Pat. No. 4,754,840 which issued Jul. 5, 1988 and U.S. Pat. No. 4,775,029 which issued Oct. 4, 1988.

The hydraulic supply to the various cylinders is generally manually controlled by an elevator operator, with separate controls of the elevating apparatus, as well as the platform structure. The structures must therefore be of a very substantial and rugged construction. Generally this requires use of heavy metal structures creating substantial weights and forces.

The over-reach of the apparatus or mechanisms relative to the base support structure creates significant over turning forces. This requires careful and effective design of the elevating mechanism in relationship to the support structure to prevent creation of a hazardous condition with the platform in an elevated position. In addition, in the collapsed position the elevating mechanism and platform should be appropriately aligned on the support structure to permit the convenient and safe transportation of the device. Thus, the platform should be centrally located on the base support unit to establish optimum distribution of the weight and forces during the transport.

Mechanical leveling of the platform and vertical support structure have been suggested by using parallelogram linkage structures interconnected between individual boom sections in various scissors and multiple articulated boom devices. Typical examples of parallelogram linkage structures are, for example, shown in Canadian Patent 990,224 which issued Jun. 1, 1976 and U.S. Pat. No. 4,935,666 which issued on Sept. 4, 1990. In such structures, a parallel arm is mounted to the boom section and interconnects through end linkages to the corresponding section and an adjacent section such that the movement of one section is transmitted to an adjacent section to maintain a predetermined angular relationship between the several sections, with an outer end section having an end support for the appropriate horizontal orientation of the platform.

In telescopic boom apparatus, a single boom unit may be used with the boom angular orientation varied by and set by the pivoting hydraulic cylinder unit. In such systems, the separate hydraulic leveling cylinder units are used to orient and maintain the proper orientation of the platform. Multiple hydraulic cylinder units require close coordination between the operation of the cylinder units. Further, hydraulic systems have various inherent disadvantages from the standpoint of possible small leakages, which can destroy synchronized movements. Normal wear in any hydraulic system can also destroy the desired synchronized movements. The hydraulic system thus require continuous maintenance and often require time consuming adjustments by the elevator operator.

In addition, the smooth and controlled movement of the platform is essential to the comfort and safety of the personnel. Such movement is also significant in connection with the minimizing of the forces placed on the elevating mechanism. This again requires relatively skilled control and operation of the lifting and lowering elevator mechanism. Systems have been suggested for minimizing the required hydraulic motors and the like and related controls. Thus, for example, in boom structures having intermediate articulated joints or couplings, gear systems have been provided for providing controlled movement of the gear mechanism in response to the hydraulic motor drive of a boom structure. The mechanical parallelogram interconnection between articulated boom sections have also been suggested.

In telescopic boom systems, however, universal practice has been the provision of the telescoping boom in combination with multiple hydraulic motor units for lifting of a pivotally mounted boom and a hydraulic cylinder motor for positioning and orienting of the platform.

A distinct demand and need exists for a simpler more reliable telescopic boom system which can eliminate the necessity for the multiple hydraulic motors and providing a stable mobile lift assembly for transport and for expanded work positioning.

SUMMARY OF THE INVENTION

The present invention is particularly directed to a telescopic boom unit and lift apparatus for positioning of a vertical support for a working platform or a further articulated boom unit through the use of a single motor unit for expansion of the telescopic boom unit in combination with a mechanical linkage system to effect the controlled pivoting of the telescopic boom unit to the working position and an automatic leveling of the support structure in response to the telescopic positioning of the telescopic boom unit. Generally, in accordance with the present invention, a base support unit is provided. The telescopic boom unit includes a base boom member pivotally interconnected to one end of the support unit and a telescoping tip boom member. A motor unit is coupled between the base and tip boom members for the extension and retraction of the boom unit. A mechanical lift linkage is pivotally interconnected between the base support unit and the telescoping tip boom member. The linkage is constructed and arranged to support the boom unit in the retracted, collapsed position and to exert a lifting and pivot force on the boom unit in response to extension forces on and with extended movement of the tip boom member. A parallelogram linkages maintain a precise orientation between the boom unit and the lift linkage, and thereby a controlled orientation of the elements secured to the boom unit. In particular, the outer end of the tip boom member includes a vertical support which is coupled to parallelogram linkages on the tip boom member for controlled orientation during the pivotal movement of the boom unit.

More particularly in a preferred construction, the base support unit is a heavy metal understructure having a support base plate. Vertical post units are secured to the opposite ends of the base plate. The telescopic boom unit includes tubular boom members with the overlapped ends mounted in sliding engagement and with appropriate guide pads located between the boom members. The boom members are preferably tubular and a hydraulic cylinder unit is mounted within the boom members with the cylinder and piston rod secured respectively to telescoping members of the tubular boom members. The base boom member includes a bracket which is pivotally mounted to the base post unit and supports the adjacent end of the base boom member in upwardly spaced relation to the base plate with the boom unit fully retracted. The retracted boom unit is pivoted downwardly with the tip boom member generally adjacent and preferably in engagement with the base plate. A platform vertical post is pivotally secured to the outer end of the tip boom member, with the platform secured to the upper end of the platform post and extended backwardly over the retracted boom unit to locate the boom unit and the platform generally located in an overlying and centered relationship to the base plate.

A lift arm unit includes a pair of parallel arms in the form of metal plate members which are laterally spaced and located one each to the opposite side of the boom unit. The lift arm unit is pivotally secured to the lift post, generally adjacent to the upper end thereof and in alignment with the upper end of the boom assembly base post. The opposite ends of the arms are coupled to the sliding portion of the tip boom member. A saddle member includes arms extending downwardly in laterally spaced relation to the sides of the tip boom member. The lift arms are pivotally interconnected to the saddle and form the pivotal connection to the tip boom member. In the collapsed position, the pivotal connection to the tip boom member is spaced upwardly and inwardly of the pivot connection of the boom unit to the base post. Extension of the telescoped tip boom member generates a turning force on the lift arm as a result of the offset pivot connection and results in a simultaneous upward pivoting of the boom unit and the lift arm unit as the outer tip boom member is telescoped outwardly of the base boom member.

The platform vertical post positioning systems include a leveler arm unit located in parallel relationship beneath the tip boom member. The arm unit is a rigid arm member which is interconnected to the saddle structure and located beneath the tip boom member. A free pivoting crank unit is pivoted to the saddle and to the leveler arm member. The leveler arm unit extend parallel to the tip boom member with the outer ends secured to the vertical post. The offset spacing of the pivot connections is such as to establish and maintain a parallel orientation between the tip boom and the leveler arm unit. A leveler arm unit for the lift arm unit is also pivotally secured to the crank unit. The leveler arm unit is located in generally vertical alignment beneath and extended parallel to the lift arm. The leveler arm unit preferably includes similar parallel rigid arms pivoted to the lift post and spaced to the opposite sides of the boom assembly in the collapsed position. The boom end of the leveler arms are pivotally interconnected to the opposite sides of the saddle with a common pivot support. The level arms are thus located in an initial and continuous parallelogram arrangement with the lift arm. As the lift arm pivots upwardly, the leveler arms pivot upwardly in constant spaced and parallel relationship as a result of the rotation of the crank unit. The rotation of the crank unit results in a corresponding rotation of the boom leveler arm to maintain the vertical orientation of the platform post or other interconnected support unit. The spaced location of the rigid leveler arms of the lift unit permits the compact collapsing of the telescopic boom unit into the lift unit and creates a compact assembly on the base support for transport and storage while providing a reliable and long life elevating apparatus requiring a single hydraulic control.

The present invention provides a telescopic boom unit having a simple mechanical linkage to properly orient the apparatus with a single motor unit for the telescopic boom unit and which can be constructed with current technology to produce a rugged, reliable and cost effective telescopic lift apparatus.

BRIEF DESCRIPTION OF THE DRAWINGS

The drawings furnished herewith illustrate the best mode presently contemplated for carrying out the invention and are described hereinafter.

In the drawings.

DESCRIPTION OF THE ILLUSTRATED EMBODIMENT

Figure 1:
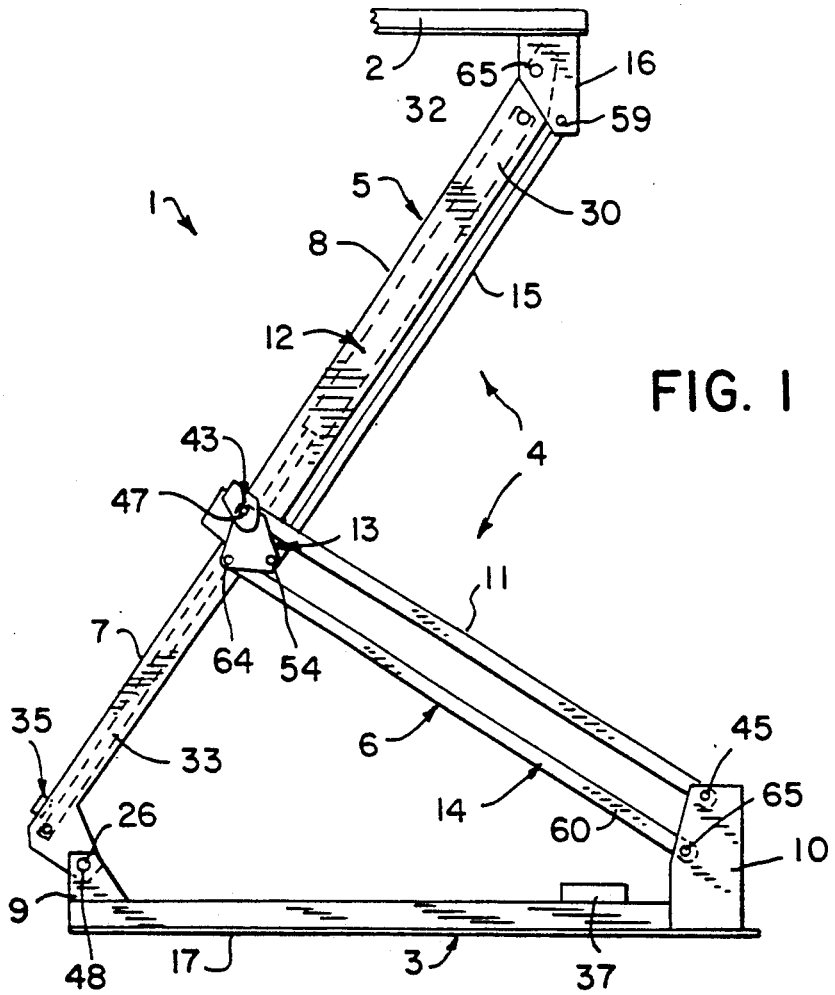
FIG. 1 is a side elevational view of a lift apparatus incorporating an embodiment of the present invention and shown diagrammatically for purposes of explanation.

Referring to the drawings, and particularly to FIG. 1, a mobile lift apparatus 1 is illustrated including a work platform 2 for supporting of operating personnel above ground level to work on elevated devices, not shown. The lift apparatus 1 includes a mobile support unit 3 for convenient transport of the lift apparatus 1 to the work area. An elevating mechanism 4 is mounted to the support unit 3 and to the platform 2 and is operable to locate the platform 2 in various raised locations generally in overlying raised orientation to the support unit. The elevating mechanism 4 also provides for collapsing of the platform and mechanism onto the support unit for safe and reliable transport between work areas. In the present invention, the elevating mechanism 4 includes a telescopic boom unit 5 in combination with a mechanical lift unit 6. The boom unit 5 includes a base boom 7 and a tip boom 8. The boom 7 is pivotally mounted on a base post 9 to one end of the support unit 3. The tip boom 8 telescopes over the outer end of the base boom 7, with the outer end of the tip boom 8 coupled to the platform 2 and supporting the platform on the outer end of the boom unit 5. The lift unit 6 is pivotally mounted on a lift post 10 to the opposite end of the base unit 3 from the post 9, with the outer end pivotally interconnected to the tip boom 8 of the boom unit 5.

The lift unit 6 is a mechanical linkage including a lift arm 11, shown and hereinafter described as a pair of arms, pivotally connected to the slide end of the tip boom 8 and to the lift post 10. The pivot couplings and connections of the base boom 7 and the lift arm 11 to the respective posts 9 and 10 are arranged and constructed such that the extension of the tip boom 8, creates a pivot force on the boom unit 5 about the pivot post 9 and on the lift arm 11 causing them to raise upwardly, to thereby simultaneously extend and pivotal raise the boom unit 5 and thereby the platform 2.

A hydraulic cylinder unit 12 is coupled to the tip boom 8 and to the base boom 7 for the extension and contraction of the tip boom 8. The hydraulic cylinder unit 12 provides a single motor means for positioning of the boom unit 5 on pivotal mount 9 and thereby raising and lowering the platform 2.

The tip boom and the lift arm units are formed as interconnected parallelogram structures to establish and maintain a level support of the platform 2 for all angular orientations of the boom unit. Generally, a coupling unit 13 is pivotally secured to the slide end of the tip boom 8. A level link unit 14 of the lift unit 6 is located in extended and parallel relation to the lift arm 11 and pivotally mounted between the lift post 10 and the coupling unit 13. A similar rigid parallel level link unit 15 is mounted in parallel relation to the tip boom 8, with the one end pivotally secured to the coupling unit 13 and the opposite end pivotally secured to a vertical post 16 to which the platform 2 is secured. The parallelogram linkages are interconnected through the coupling unit 13, whereby the lifting motion created by the lift unit 6 results in a corresponding movement of the level link unit 14 and through coupling unit 13 provides for the automatic and continuous positioning of the boom level link unit 15 to pivot the post I6 and attached platform 2 about the tip boom 8 to maintain a predetermined horizontal orientation and support of the platform 2.

The present invention thus provides a telescopic boom unit 5 with a single hydraulic operator requiring a single lever control for extension and contraction of the telescoping boom, with simultaneous raising and lowering of the platform 2 in a predetermined orientation through the simple mechanical linkages of the lift unit 6. The linkages are readily constructed with present day technology to provide long operating, reliable life with minimum maintenance. Further, any maintenance and repair required can be readily attended to with basic mechanical skills and knowledge of the system.

More particularly, in the illustrated embodiment the support unit 3 includes a base plate 17 of a relatively heavy metal with wheeled cut-out portions. Wheel brackets I8 are welded or otherwise secured within the cut-out portions and support suitable vehicle wheels 18*a* for transport of the lift apparatus 1.

The boom post 9 is centrally secured to the one end the base plate 17 between the wheel brackets 18. The lift post 10 is centrally secured to the opposite end of the base plate 17. The posts are joined by laterally spaced parallel members shown as rectangular tubes 19 which extend the length of the base plate and are interconnected as an integrated part of the spaced post structure for supporting of the boom unit 5 and the lift unit 6.

Figure 2:
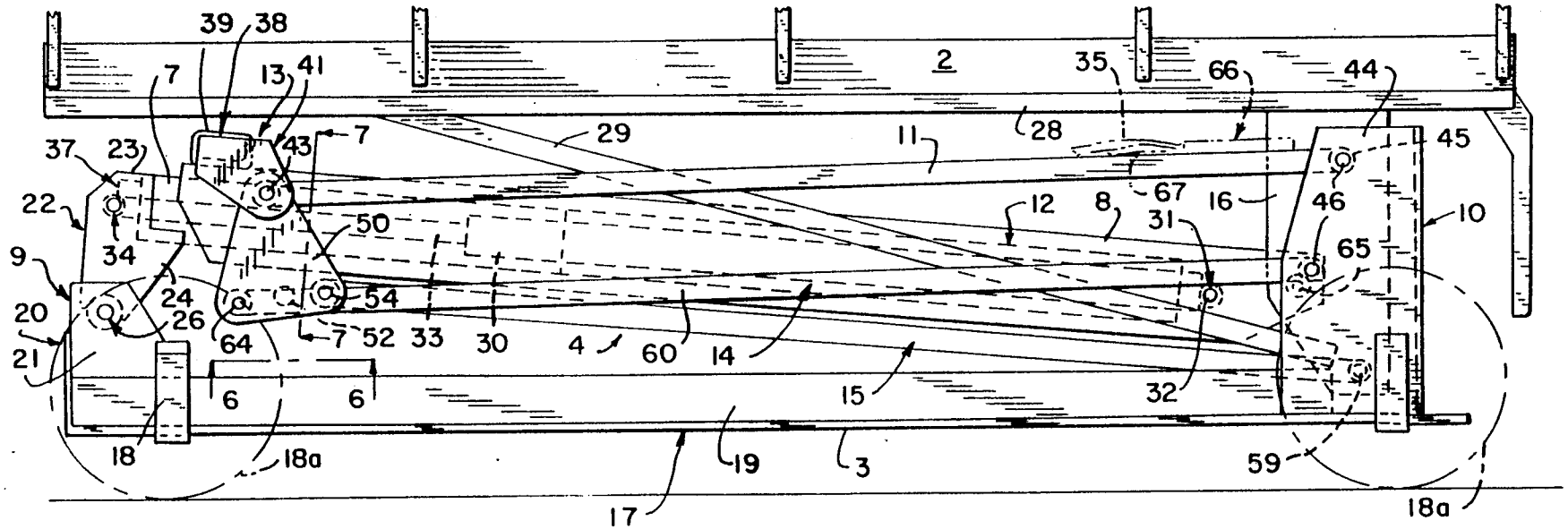
FIG. 2 is a side elevational view of an apparatus shown in FIG. 1 in greater detail and in a collapsed transport portion.
Figure 3:
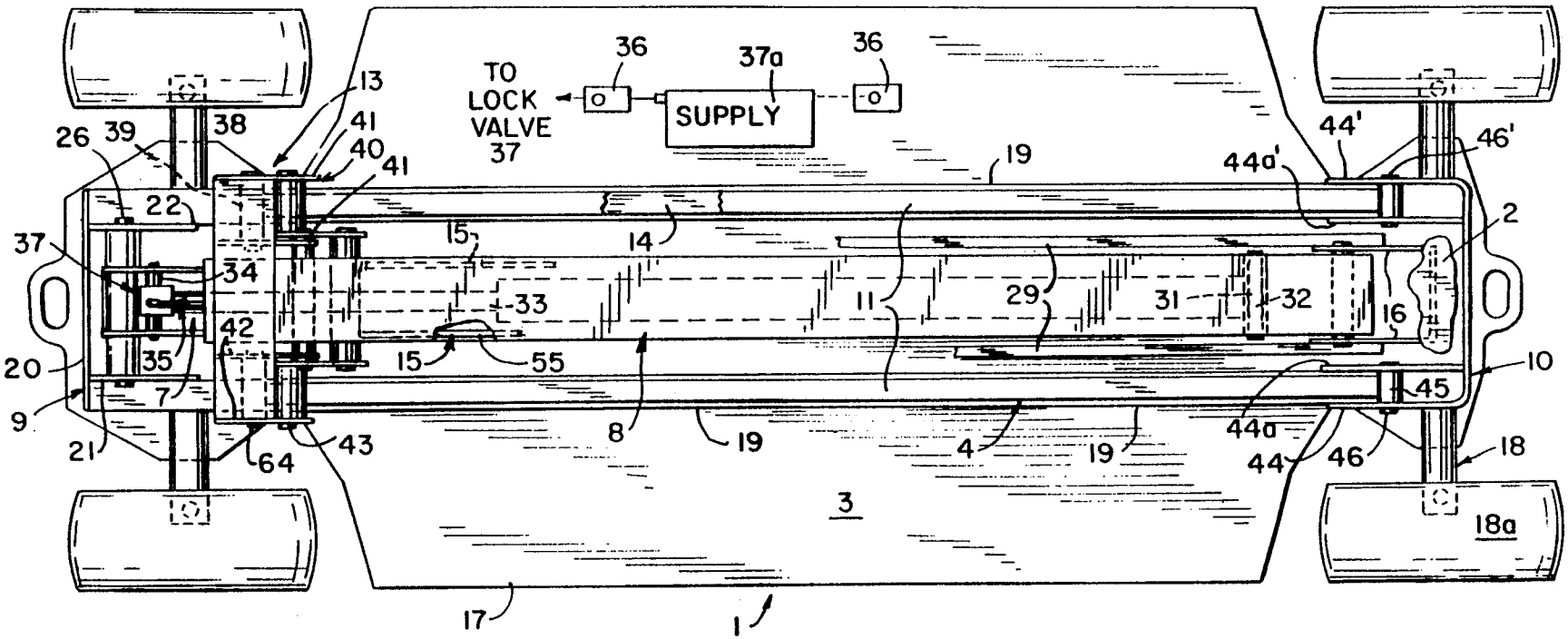
FIG. 3 is a plan view of the apparatus as shown in FIG. 2.
Figure 4:
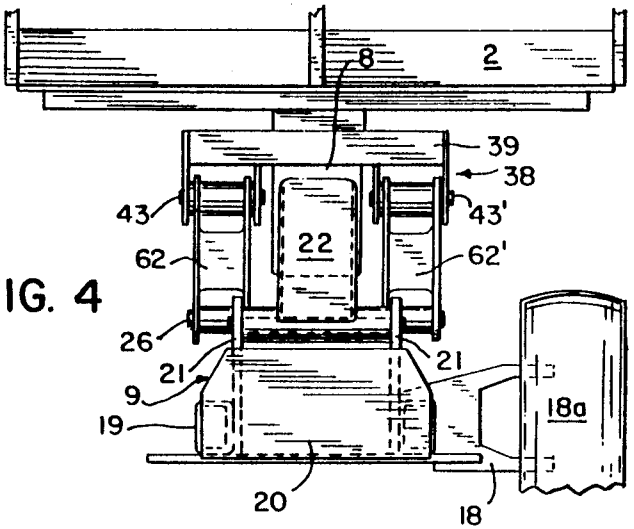
FIG. 4 is an enlarged fragmentary end view with parts broken away and sectioned to more clearly illustrate the pivotal mounting of telescopic boom unit between the positions of FIG. 2.

Referring to FIGS. 2–4, the boom post 9 includes an end plate 20 extending upwardly from the base plate 17 and the ends of the rectangular tubes 19. Upstanding pivot plates 21 are secured as by welding within the rectangular tubes 19 and the end plate 20 and project slightly upwardly therefrom to receive boom 8.

The boom unit 5 includes the tubular base boom 7 having a rectangular cross section with the one end pivotally mounted by a pivot bracket 22 between the pivot plates 21. The pivot bracket 22 is a box-like and L-shaped member having one leg 23 welded in interfitting relationship to the end of the tubular base boom 7 and a second leg 24 shown as a pair of depending side plates projecting normal to the boom 7 and downwardly between the pivot plates 21. A pivot pin unit 26 is located between the pivot plates 21 and pivotally supports the boom unit 5. The boom unit is supported in the collapsed position, as shown in FIG. 2 and 3, with the pivoted end located upwardly of the pivot pin unit 26. The boom unit 5 extends across the base plate 17 and terminates located within the lift post 10.

The tip boom 8 is a tubular member of a rectangular cross section similar to but larger than that of the base boom 7. The tip boom 8 telescopes over the base boom 7 with suitable conventional or other suitable slide pads 27 therebetween to slidably support the tip boom on the base boom.

The outer end of the tip boom 8 is connected to the platform 2 and particularly to the vertical platform post 16 which is secured to the underside of the floor of the platform.

The platform post 16 is shown as a channel-shaped member secured to the underside of a flat floor unit 28 of the platform. Braces 29 are secured to the lower end of the post 16 and extend outwardly and upwardly into fixed securement to the underside of the platform floor unit 28. The platform 2 is generally of any desired construction and generally include the floor unit 28 is approximately as long and wide as the base plate 17. In the lowered position, the platform extends from the post 16 in aligned relation with the base plate. Although not shown, the post structure and interconnection to the floor can be provided with a rotating structure to permit relocation of the platform relative to the post to vary over-reach position within an enlarged work area. This of course changes the load on the mechanism and consideration must be given to such loading.

The positioning of the tip boom 8 and platform 2 is controlled by extension and retraction of the cylinder unit 12. The hydraulic cylinder unit 12 is mounted within the telescoped tubular booms 7 and 8. In the illustrated embodiment of the invention, the cylinder unit 12 includes a cylinder 30 pivotally secured at the outer end to the outer end portion of the tip boom 8. The end of the cylinder 30 includes a bearing journal 31 on a pivot pin 32 which is secured within the tubular tip boom 8. The piston rod 33 of the cylinder unit 12 projects from the inner end of the cylinder 30 and is similarly secured by a pivot pin and bearing member 34 within the boom pivot bracket 22 on the end of boom 7. A hydraulic fluid line 35 is secured to the lower end of the cylinder 30 for the controlled extension and retraction of the tip boom 8 relative to the base boom 7.

The single hydraulic cylinder unit 12, which is mounted within the boom structure, improves the physical and environmental protection of the assembly. Further, the use of the single cylinder unit 12 and the mechanical lift unit 6 requires the single directional and speed control valve 36. The lift control system itself can also use a simple on/off full pressure flow hydraulic control valve including a lock valve 37 connected to a suitable pressurized supply 37*a*, with the cylinder fluid line 35 connected between the lock valve and the directional and speed control valve 36 to supply hydraulic fluid to the cylinder. Thus, the system may be a single control system which does not require additional load and moment controls. This structure and control simplifies the operation as well as the service and maintenance of the system. Thus, the system provides a reliable and relatively simple system control to the operator and by appropriate servicing improved overall reliability.

Figure 3A:
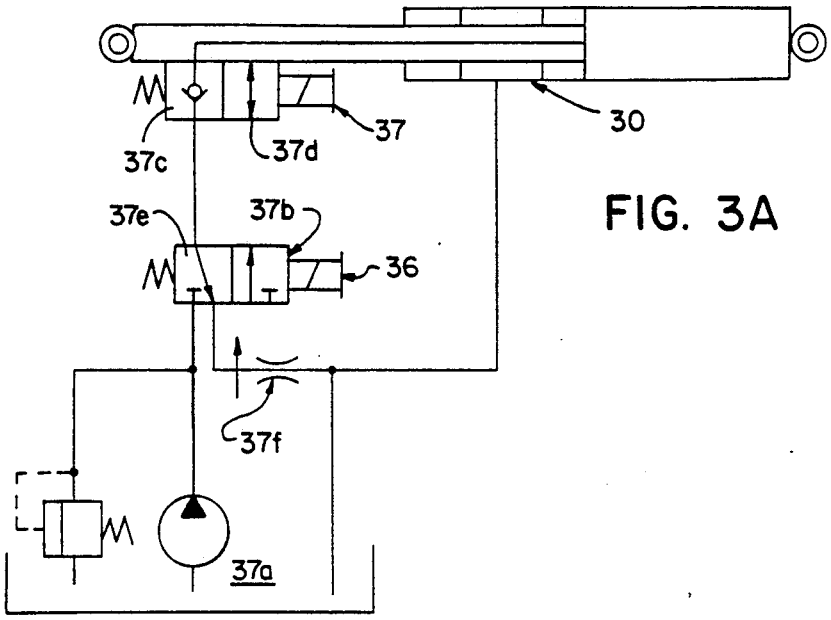
FIG. 3A is a schematic of the hydraulic systems for raising and lowering the boom.

A hydraulic schematic including the directional and speed control valve 36 and the lock valve 37 is shown in a known hydraulic system for controlling the position of the platform and is shown in FIG. 3A. The control valve 36 is shown as a spring-loaded two position valve having a valve section 37*b* for selectively connecting the high pressure side of the supply 37*a* to the cylinder 30 in series with the lock valve 37. The return side of the cylinder 30 is connected directly to the supply reservoir. The lock valve 37 is a spring-loaded, electrically actuated unit having a standby position in which a check valve section 37*c* is connected to the supply line and an actuated position with a direct flow section 37*d* is connected to the line. The check valve section 37*c* permits flow to the cylinder 30 for extension of tip boom unit, and locks the cylinder 30 in the extended position. Actuation of the lock valve 37 moves the pass-through passage in-line with the supply line for retraction of the cylinder 30 and lowering of the boom unit 5.

The control valve 36 includes a retract section 37*e* which connects the valve flow section 37*d* to the hydraulic reservoir 37*a* in series with a flow control orifice 37*f* in the non-actuated or standby position of the valve 37.

In this state of the control valve 36, actuation of the lock valve 37 to the open actuated position establishes flow from the extended side of the cylinder 30 through the orifice 37*f*.

With the lock valve 37 open and control valve 36 in the retract position, the gravity forces acting on the boom assembly or unit 5 cause the cylinder 30 to collapse, with the boom unit 5 and lift unit 6 collapsing therewith. The retraction is controlled by the internal sliding friction forces within the telescopic boom unit 5 and the linkage mechanisms as well as the axial compressive force on the boom lift arms. By reducing of the cylinder pressure, the boom will retract and lower simultaneously until the hydraulic cylinder is at its minimum position and the total assembly is lowered to the support position on the mobile base plate.

Figure 7:
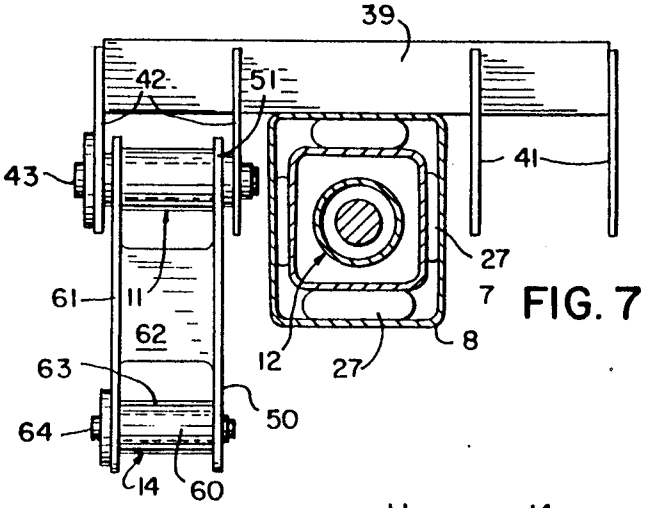
FIG. 7 is a sectional view taken generally on line 7—7 of FIG. 2 and further illustrating the coupling between the telescopic boom unit and the mechanical lift linkage.
Figure 6:
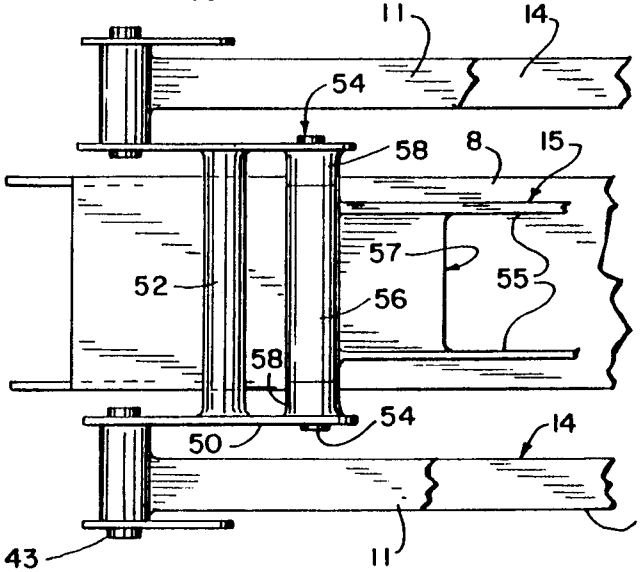
FIG. 6 is an enlarged fragmentary bottom view taken on line 6—6 of FIG. 2 illustrating the pivotal mounting of the telescopic boom unit and the mechanical lift linkage.

The boom unit 5 and particularly the tip boom 8 is coupled to the lift unit 6 through coupling unit 13 as follows. Referring particularly to FIGS. 2, 4, 6 and 7, the sliding end of the tip boom 8 is provided with an overlying saddle 38 which includes a mounting box beam 39 welded or otherwise secured to the outer wall of the tip boom 8. The saddle 38 is symmetrically formed with pairs of depending brackets 42 and 41 on opposite sides of the boom for coupling of the boom unit 5 to the lift unit 6. Referring particularly to FIGS. 6 and 7 and particularly to the bracket 40 shown to the left side of the illustration for purposes of description, the bracket 40 includes spaced pivot plates 42 extending parallel to the side of the tip boom 8. The lift arm 11 is pinned within the depending plate 42 by a pivot pin unit 43 extended through the depending bracket plate 42 and journals on the adjacent inner end of the arm 11. The lift arm 11 is a rigid rod member which extends from the saddle to the lift post 10.

Figure 5:
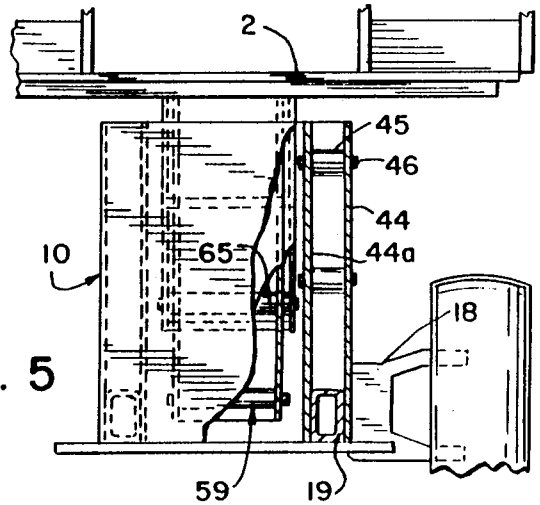
FIG. 5 is an enlarged fragmentary end view with parts broken away and sectioned to illustrate the pivotal mounting of the lift apparatus and the support connection of an operational platform.

As shown in FIGS. 2 and 5, the lift post 10 is a channel-shaped member secured on the centerline of the base plate between the wheel brackets 18 and with the side plates 44 abutting the rectangular tubes 19. The post 10 extends upwardly above the level of the top of the base boom post 9. The channel post 10 includes an internal vertical wall 44a projecting upwardly from the inner side of the rectangular tube bar 19 and defining an opening for receiving of the end of the lift arm 11. A journal 45 is welded or otherwise secured to the end of the lift arm and mounted on pin 46 secured within the side plate 44 and plate 44a of the post. In the collapsed position, the lift arm 11 extends between the pivot end of the boom 8 and the upper end of the lift post 10, as shown in FIG. 2. The second lift arm 11 is similarly secured to the opposite side of the saddle 38 and to the opposite side of the lift post 10. The mounting structure of the second arm 11 is shown by primed numbers.

The lift arms 11 are thus pivotally mounted in fixed pivotal relation to the boom 8 at pivot pins 43 and to the post 10, at pivot pins 46. Lift arm 11 is free to pivot about the post pivot pin 46 in both directions and functions to effect a raising and lowering of the boom unit 5 simultaneously with and in accordance with corresponding movement of the hydraulic cylinder unit 12.

As shown in FIGS. 1 and 2, the axis 47 of the lift arm 11 at the boom pivot pin 43 is always above the horizontal center line and axis 48 of the boom pivot pin unit 26. The perpendicular offset distance between these two axii 47 and 48 defines a moment arm which varies from a minimum in the collapse boom position of FIG. 2 to the maximum in the fully extended boom position of FIG. 1.

When the boom is in the collapsed position, hydraulic fluid is supplied via the supply 37a to the cylinder 30. The cylinder 30 tends to move outwardly creating a turning force or moment acting through the minimum moment arm. This provides a torque moment on the outer end of the lift arm 11 at its connection to the tip boom 8 causing the arm 11 to pivot upwardly and carry the boom 8 upwardly with cylinder 30 moving outwardly during the raising motion. As long as the outward force exceeds, the combined gravitational forces acting on the hydraulic cylinder 30, the boom 8 will extend with the arm 11 and boom unit 5 moving upwardly until the fully extended or maximum stroke of the cylinder unit is established. The moment arm increases with the outward extension. The boom is held extended by holding a hydraulic force on the assembly in excess of the gravitational forces acting on the boom unit 5.

The gravitational forces acting on the boom unit 5 includes the various elements interconnected to the boom unit 5, including the lift unit 6, the platform 2 and interconnecting post 16, as hereinafter described. To lower the boom unit 5, the hydraulic pressure to the cylinder unit I2 is reduced by setting the lock valve to allow the hydraulic liquid in the cylinder 30 to return to the reservoir of the supply unit 37a. The gravitational forces acting on the boom unit cause it to retract and simultaneously move in a clock-wise direction about the boom pivot pin 26 at the base post 9, with the arm unit 6 pivoting downwardly in a reverse movement. The gravitational return forces are resisted by the axial compressive force of the boom lift arms 11 acting again between the perpendicular moment arm length, between the bcom pivot pin 26 and the lift arm pivot pin 43 and in essence is the same but reverse motion establish when lifting of the arm. The actual downward speed will depend on the gravitational forces, the controlled release of the hydraulic pressure from the cylinder, and the forces in the mechanical linkage system.

The platform leveling mechanism consist of the leveling arm unit 15 coupled to the tip boom 8 to form a parallelogram structure and the lower leveling arms 15 coupled with the lift arms 11 to form a parallelogram structure. The leveling arms 15 and 11 are interconnected to each other via coupling unit 13 which includes identical crank levers 50 pivotally mounted to the opposite ends of the saddle structure 38 as follows.

As shown most clearly in FIGS. 4, 6 and 7, the crank lever 50 is generally a triangular shaped member having an apex 51 pivotally secured to the lift arm pivot pin unit 43 within the saddle unit 38. The crank lever 50 extends downwardly and freely pivots on the pin 43. Thus, the lift arms 11 and the crank lever 50 share the common pivot units and particularly pin 43.

A cross beam 52 interconnects the two crank levers 50 for simultaneous and corresponding positioning. In the collapsed position, the crank levers 50 extend downwardly with the two lower apexes in general horizontal alignment.

The outer apex 53 of each crank lever is coupled by a common pivot 54 to each other and to the boom leveling arm unit 15, as most clearly shown in FIG. 6.

The boom leveling arm unit 15 includes a pair of spaced rigid plates 55 interconnected at the boom end in a journal 56 which is pivotally located on the pivot pin 54. A strengthening plate 57 is welded between the rigid plates 55, the journal 56 and the two lift plates 55. The spacing of the lift plates is slightly less than the width of the tip boom 8. The crank levers include small journals 58 welded thereto in alignment with the journal 56. The arm plates 55 extends outwardly beneath the tip boom 8 and in parallel relationship thereto. The outer ends of the plates 55 are pivotally secured to the platform post 16 by pivot pin unit 59 and defines a parallelogram linkage therewith. Thus, the length of the leveling arm unit 15 is equal to the length of the tip boom 8 between the pivot connections to the crank levers 50 and the platform post 16.

The lift leveling arm unit 14 includes the pair of identical leveling arms 60 which are interconnected between the crank levers 50 and the lift post 16 in relationship to the lift arm 11 to form a parallelogram linkage structure as follows. Referring to the one leveling arm 60 and particularly as shown in FIGS. 6 and 7, a lever plate or link 61 is pivotally mounted on the pivot pin 43 at the saddle 38. The lever link 61 is located to the outside of the arm 60 and depends downwardly in alignment with the back edge of the crank 50 and is interconnected thereto by a cross-beam 62 (FIG. 7) located centrally of the members. The lift leveling arm 60 includes an end journal 63 located between the lever link 61 and the crank 50 and is pivoted in place by a pin 64 extending through the crank lever and the journal. The leveling arm 60 extends parallel to the lift arm 11 and is pivoted at the outer end within the lift post 10 by a pivot pin unit 65. Again, the length of the lift arm 11 and the lower leveling arm 60 are essentially identical, and the pivot pins 46 and 65 located in the lift post 10 are offset slightly to reflect the same offset at the bell crank.

In the same construction, the second leveling arm 60 is constructed and interconnected to the opposite side of the boom unit 5 and the boom lift arm unit 6.

As more clearly shown in FIG. 2, the boom unit 5 and platform post 16 in the collapsed position are located centrally within the channel shaped lift post 10, with the lift arms 11 and lift leveling arms 60 located to the opposite side thereof and interconnected to the lift post 10 as described above.

In the prior art structures using platform leveling linkages, the parallel arms are generally more closely spaced than that implied in the present embodiment of this invention. The increased spacing used in the illustrated embodiment is desirable as it increases the structural efficiency of the platform leveling linkages and once again establishes a more suitable construction for platforms which are larger or have higher load ratings, as well as supporting of side moments and loads. This feature would contribute to the stability and rigidity of a system which built the structure with the platform mounted for rotational positioning onto its support.

The coupling unit 13 provides a common connection between the boom and lift leveling arm units 14 and 15. The previously described raising and lowering of the boom unit 5 causes the cranks 50 to rotate. The raising motion of the boom unit 5 causes the cranks 50 to rotate clockwise about the common pivot pins 43 as viewed in FIGS. 1 and 2. The clockwise motion of cranks 50 is positively controlled by the mechanical action of the left parallelogram structure defined by the lower lift arms 11 and the lower leveling arm unit 14. The angular motion dictated by this lower mechanical linkage 6 is an exact duplicate of the boom unit angle with respect to the base frame, and is transmitted via the crank levers to the tip boom leveling arms unit 15. As a result, an exact duplicated pivoting movement of the boom leveling unit 14 is created and the platform post 16 rotates about its pivot pin unit by an amount equal to the rotation of the cranks 50 relative to the boom. The combined motion of the platform post and leveling linkage provides a positive mechanical positioning and control of the vertical orientation of the vertical platform post 16. Thus, the platform post 16 is always maintained in its vertical position.

The platform, which is rigidly affixed to the upper end of the post 16 and in a perpendicular relationship thereto, is thereby always maintained in a horizontal or level position and the optimum operating position.

A hose and cable unit 66 including hydraulic line 35 and other control hoses and lines 67 for operating of the hydraulic cylinder unit 12 and other control and equipment secured to the boom is conveniently located and secured to the platform lift and leveling linkage unit 6, with the cylinder line 35 connected directly to the boom cylinder 30. This eliminates the necessity for a conventional complex mounting such as hose and cable reels and supporting, telescopic tubes or other similar hose/-cable carriers normally used with conventional telescopic booms. The relationship between the lift/leveling mechanism and the telescopic boom assembly maintains a generally fixed relationship other than for the angular orientation therebetween. This can be readily provided for by appropriate flexible or rotating connections adjacent to the interconnection between the lift unit 6 and tip boom 8.

Further, the use of a single hydraulic cylinder with the simplified cable and hose construction further contributes to a reduction in the overall cost of the apparatus without adversely effecting and in fact providing an improved control system. Thus, a single hydraulic cylinder unit avoids the necessity for providing synchronism between the multiple hydraulic cylinder units and similar controls found in conventional telescopic boom lift apparatus of the prior art.

As illustrated, the illustrated embodiment of the present invention which automatically elevates and lowers the boom assembly with the extension and retraction of the boom assembly through the mechanical linkage unit 14 in combination with the fixed platform mounting to the post 16 also minimizes the platform side reach. As a result of the action, the maximum overturning moment acting on the mobile vehicle is reduced, and the counterbalancing weight of the vehicle necessary to overcome the side reach loading is minimized. The reduced side reach loading of course provides a corresponding lower loading on the mechanism and reduces the size and structural strength requirements of the mechanism. The reduced loading and strength requirements also permits a significant cost reduction in the material cost as well as the labor cost associated with construction of the system.

The boom assembly is mounted on the center line of the apparatus between the supporting wheel structure, as shown in FIGS. 3, 4 and 5. The mechanism thus minimizes the eccentric vertical loading and proportional loading imposed on the boom structure. This reduced loading improves the overall strength and rigidity to weight ratio of the mechanism and provides a more structurally efficient unit. The use of the single telescopic assembly also, with the center mounting, allows the use of relatively wide pivot connections of the boom unit and the lift unit at both ends of the mechanism with a resulting improved stability of the platform and the mechanism. Thus, the structure eliminates the normal bearing clearance required at multiple pivot joints and allows wider pivot joints, both of which contribute to improved overall mechanical stability and action. The telescopic boom assembly is particularly advantageous with larger platforms and higher platform capacities, in contrast to the other conventional articulated structures which may include multiple boom sections interconnected by gear mechanisms, with the inherent backlash which limit their use.

The linkage mechanism of the present invention with the boom unit collapsing into the lift unit allows the total assembly in the collapsed position to have a low overall height and at least corresponding to other conventional lift mechanisms using articulated boom members.

The present invention is equally applicable to a telescopic boom system including additional boom units in which the overreach of the outer boom is preferably held to a minimum. For example, a multiple boom unit 70 is illustrated in FIG. 8 using a mechanical linkage 71 to simultaneously raise a telescopic boom unit 72, with a second boom unit 73 extending from the tip boom 74 of the boom unit 72 and with the orientation of the second boom unit held in overlying relationship to the first boom unit and the support.

Figure 8:
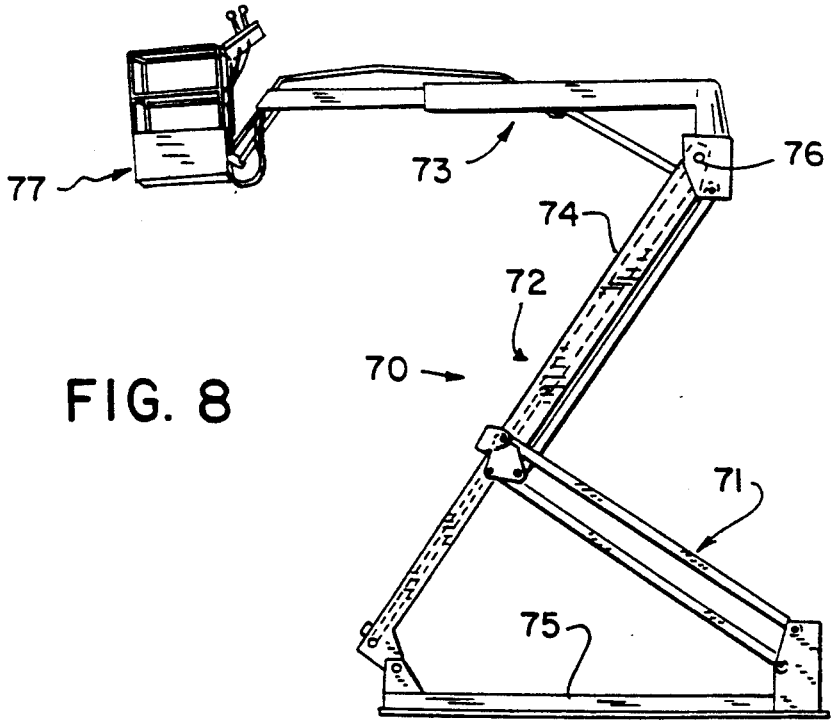
FIG. 8 is a view similar to FIG. 1 illustrating an alternate embodiment of the invention.

In the illustrated embodiment of FIG. 8, the telescopic boom unit 72 is connected to the base support unit 75 with a lift linkage unit 71, as in the first embodiment. A support post 76 is secured to the outer end of the tip boom 74 of unit 72 and maintains its vertical orientation, and moves essentially vertically upwardly from the support unit 75. The second boom unit 73 is illustrated as a telescopic unit pivotally secured to the upper end of the vertical post 76. The boom unit 73 projects backwardly in overlying relationship to the boom unit 72. A working platform 77 is secured to the outer end of the second boom unit. A suitable connection between the two boom units is provided to orient the second boom unit which may provide for orientation thereof between a horizontal and angulated orientation with respect to the vertical post. In the illustrated embodiment of the invention, the second boom is held in the horizontal orientation, but other interconnecting supports may be provided. For example, if the orientation of the second boom unit is to be maintained in a similar angular orientation but in a reversed direction from that of the first boom unit, a conventional gear or force unit may be interconnected between the two units to establish the corresponding position of the second boom unit.

Figure 9:
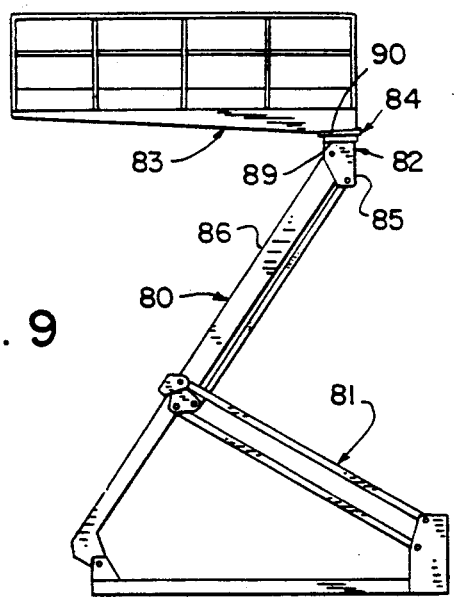
FIG. 9 is a view similar to FIG. 1 illustrating a further embodiment of the invention.
Figure 10:
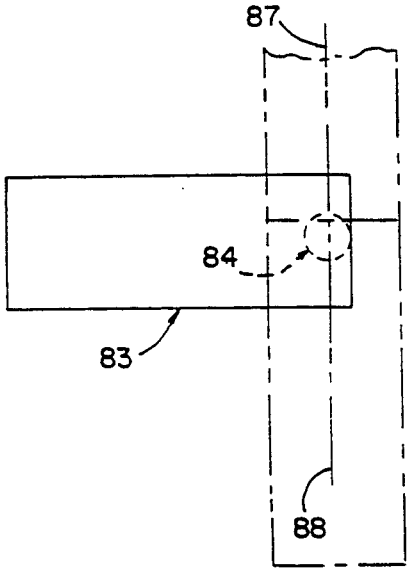
FIG. 10 is a plan view of the embodiment shown in FIG. 9.

A further embodiment of the invention is shown in FIGS. 9 and 10 including a telescopic boom unit 80 and an interconnected lift unit 81 corresponding generally to the embodiment of FIGS. 1-7. The units 80 and 81 are shown in generally simplified illustration, with a special mounting unit 82 of the platform 83 to the telescopic boom unit 80. The mounting unit 82 includes a rotatable bearing unit 84 allowing horizontal rotation of the platform about a vertical support post 85 secured to the tip boom 86 of the boom unit 80. The vertical support 85 holds the platform 83 in a horizontal plane as in the prior embodiment. The rotatable assembly 84 permits rotation of the platform 83 through angles 87 and 88 of ninety degrees to either side of a normal alignment of platform 83 with the telescopic boom unit 80, as shown in FIG. 10.

The rotatable bearing unit 84 includes a base bearing plate 89 secured to the top of the support post 85. A platform plate 90 is secured to the mount end of the platform and is rotatably affixed to bearing plate 89. The bearing unit 84 may be any suitable unit such as a commercially available 4 point contact ball bearing unit to carry both the radial and thrust load and the moment load for all positions of the platform 83, through the designed 180 degree positioning of the platform.

The special mounting of the platform 83 is facilitated by the substantially vertical alignment of the collapsing boom unit and lift unit. The aligned boom and lift units are mounted to the base support with relative wide pivot supporting structure. As a result, the collapsing support assembly is adapted to carry the relative large load forces created by the angulated location of the platform to the side of the collapsing support, as shown in FIG. 10.

The present invention is applicable to any telescopic boom unit apparatus in which it is desirable to establish a predetermined orientation of a post structure while a providing a single hydraulic control and a mechanical linkage to establish such a system.

Although shown in a particular preferred construction, various modifications and variations can obviously be incorporated into this system. Thus, the illustrated embodiments are particularly desirable in providing a compact structure with reduced moment loads in operation and use as well as providing a cost efficient construction. The positive mechanical linkage to lift the telescopic boom unit as well as to maintain the orientation of the outer pivoted support structure eliminates the necessity for auxiliary override controls to correct for any platform leveling errors associated with hydraulic controls or other master slave leveling structures.

Various modes of carrying out the invention are contemplated as being within the scope of the following claims particularly pointing out and distinctly claiming the subject matter which is regarded as the invention.

I claim:

1. A telescoping lift apparatus comprising a base support structure, a telescopic boom unit, a first pivot unit secured to said boom unit and to said base. support unit, an outer support unit secured to the outer end of the boom unit, a motor means coupled to extend the tip boom of said telescopic boom unit, a mechanical lift linkage unit connected to said support structure and to the boom unit, said connection of said lift linkage unit to said boom unit including a second pivot unit, said second pivot unit being maintained in vertically upward spaced relation to said first pivot unit, said first and second pivot unit configuration creating an upward pivot boom whereby said boom unit having an outer tip boom and said lift linkage unit force on said linkage unit with the extension of said tip boom whereby said boom unit having an outer tip boom and said lift linkage unit simultaneously move vertically upwardly.

2. The telescoping lift apparatus of claim 1, wherein said boom unit and said lift unit are mounted in vertical alignment, said lift unit being constructed with spaced lift members and said boom unit being collapsibly within the lift unit.

3. The apparatus of claim 1, having a first parallelogram linkage structure connected to said boom unit and to said support unit, a second parallelogram linkage structure connected to said lift linkage unit and said first and second linkage structures being coupled to each other at said second pivot unit of the lift linkage unit to the boom unit whereby the pivoting of the lift linkage unit results in pivoting of the parallelogram linkage structures with the lift linkage unit and said parallelogram structures maintaining said support- unit in the same orientation for all pivot positions of said boom unit.

4. The telescoping lift apparatus of claim 3, wherein said second pivot unit includes a pivot pin connecting said lift linkage unit to said boom, said parallelogram structures each including a leveling.arm, a connecting plate member pivotally mounted to said pin, said parallelogram structures each having said leveling arm pivoted to said plate member and located in spaced parallel relation to said lift arm and said boom.

5. The apparatus of claim 3, having a boom support unit secured to the base support structure and wherein said lift linkage unit includes a pair of laterally spaced lift arms in the form of an elongated rigid member, said lift arms being laterally spaced and located to the opposite sides of said boom unit, said second pivot unit includes a saddle member secured to the boom unit and including boom pivot plates projecting downwardly over the sides of the boom unit, common pivot pin units secured to said pivot plates, said lift arms being pivotally mounted on said pivot pin units, a lift support unit aligned with said boom support unit, said arms projecting across said base structure to said lift support unit, pivot units secured to said lift support unit and to the outer end of said lift arms and pivotally supporting said lift arms, said last named lift pivot units being located vertically above said first pivot unit connecting said boom unit to said base support unit, said second parallelogram structure including a pair of rigid lift leveler arms aligned with and beneath said lift arms, said leveler arms being pivotally secured to said lift support unit in vertically spaced orientation with respect to said lift arm, pivot brackets pivotally secured to said boom pivot plates and depending downwardly therefrom and located laterally of the boom unit and the lift linkage unit, said leveler arms of said lift linkage unit being pivotally mounted to the lower ends of said pivot brackets and defining said second parallelogram structure, said first parallelogram structure of said boom unit including a boom leveler arm unit located beneath said boom unit and in vertical alignment therewith, the inner end of said leveler boom arm unit being pivotally secured to said pivot brackets and extending outwardly in parallel spaced relation beneath said boom unit to said outer support unit, pivot means interconnecting the outer ends of said boom leveler arm unit to said outer support unit to define said first parallelogram structure, whereby said leveler arms of said lift linkage unit rotate said brackets and correspondingly reposition the leveler arms of said boom leveler arm unit to maintain the orientation of said outer support unit in a predetermined orientation.

6. The apparatus of claim 1, including a second boom unit, a second boom pivot unit connected to said second boom unit and to said outer support unit and projecting outwardly in overlying relation to said first boom unit, said second boom pivot unit including means to simultaneously pivot said second boom unit upwardly and outwardly of said first named boom unit.

7. The apparatus of the claim 6, wherein said means for pivoting of said second boom unit is operative to maintain said outer support unit for said second boom unit is maintaned is maintained in a continuous vertical orientation.

8. The apparatus of claim 2., wherein said outer support unit includes a rotatable bearing unit, a platform secured to said bearing unit for positioning said platform within a horizontal plane.

9. The apparatus of claim 8, having said rotatable bearing unit being selectively positioned through substantially one hundred and eighty degrees including a first position with the platform located in overlying alignment with said telescoping boom unit and a second position with the platform located at ninety degrees to the first position and third position with the platform located at one and eighty degrees to said second position.

10. A telescopic boom elevator apparatus for selectively positioning a structure in an elevated position, comprising a base support unit adapted to be mounted in a firm supporting ground engagement, a telescopic boom unit having a base member and a telescoping tip member, a support structure connected to the outer end of said tip member, a first pivot unit pivotally mounting said base member to said base support unit, motor means coupled to said base member and said tip member and operable to reciprocally position said tip member longitudinally of said base member and selectively establish extension and retraction of said boom unit, a mechanical lift unit of a fixed length and having laterally spaced and parallel lift members located to the opposite sides of the boom unit, a second pivot unit connected to the proximal end of the tip member and said lift unit, a third pivot unit connected to said lift unit and said support unit in spaced relation to said first pivot unit, said mechanical lift unit being constructed and configured to define a vertical plane of movement of said telescopic boom unit and pivoting said telescopic boom unit about said first pivot unit and said second pivot unit to raise and lower the outer end of the tip member in response to extension and retraction of said telescopic boom unit, said telescopic boom unit being collapsible into said lift unit and between said lift members.

11. The apparatus of claim 10, including a crank unit coupled to the proximal end of said tip member with a common pivot axis with said second pivot unit, a boom leveler arm mounted parallel to the telescopic tip member and having a first pivot connection to the crank unit and a second pivot connection to said support structure, a lift leveler arm located parallel to the lift unit and having a first pivot connection to said crank unit and a second pivot connection to said base support unit and defining a parallelogram structure with said lift unit, whereby activating of the motor means to raise and lower said telescopic boom unit simultaneously reorients said support structure to maintain a constant orientation of the support structure.

12. The apparatus of claim 11, wherein said boom leveler arm is mounted below the tip member, and said lift leveler arm includes a first and second arms mounted one each below said lift members.

13. The apparatus of claim 11, wherein said motor means includes a hydraulic cylinder unit including a piston rod assembly projecting from a power cylinder, said hydraulic cylinder unit being mounted in parallel relation to said telescopic boom unit with said cylinder interconnected to the outer end of a first of said base boom member and said tip boom member and said piston rod connected to the outer end of the second of said base boom member and said tip boom member, whereby the expansion and contraction of said cylinder unit results in a corresponding movement of said base boom member and said tip member.

14. The apparatus of claim 11, wherein said crank unit includes a plate member, said plate member being mounted on said first pivot connection and extending downwardly from said first pivot connection, and having said first pivot connections of said boom leveler arm and said lift leveler arm connected in spaced relation to said plate member.

15. The apparatus of claim 13, wherein said boom leveler arm includes first and second rigid arm members, said first and second pivot connections of said rigid arm members including pivot pins with a common axis of rotation secured to said plate members and to said support structure.

16. The apparatus of claim 13, wherein said lift leveler arms includes first and second rigid arm members, said first and second pivot connections of said rigid arm members including pivot pins with a common axis of rotation secured to said plate members and to said support unit.

17. The apparatus of claim 16, wherein said boom leveler arm includes first and second rigid arm members, said first and second pivot connections of said rigid arm members including pivot pins with a common axis of rotation secured to said plate members and to said support structure.

18. The apparatus of claim 12, including a rotatable unit secured to the support structure, a platform secured to the rotatable unit to support said platform for positioning within a horizontal plane.

19. The apparatus of claim 16, wherein said platform has a central position aligned with the telescopic boom unit and angulated positions rotatable to opposite sides of said central position, said angulated positions being no greater than ninety degrees from said central position.

20. An elevating apparatus having a collapsed storage position and adjustable elevated positions for locating an operating support unit in a raised operating location, comprising a base support having spaced first and second ends, a first vertical post secured to the first end of said base support, a second vertical post secured to the second end of said base support, a telescopic boom unit having a base boom with a mount end and an outer end and a tip boom member having an inner proximal end mounted in telescopic coupling over said outer end of the base boom member and having an outer end, a support post pivotally mounted to said outer end of said tip boom member, a base pivot unit connecting the base boom member to the first vertical post and adapted to locate the boom unit resting on the base support and permitting pivoting the boom unit upwardly to angulated extension from the base support, a motor unit connected between said base boom member and said tip boom member for extending said tip boom member outwardly of the base boom member, an elongated rigid lift arm, a pivot unit connecting the lift arm to the second vertical post, a common pivot unit connecting the lift arm to the proximal end of said tip boom member, the axis of said common pivot unit located above the axis of said base pivot unit and located between said first and posts whereby extending said tip boom member creates a pivoting force on said boom unit at said boom pivot unit and thereby simultaneously pivoting the telescopic boom unit and said lift arm unit with extending movement of the tip boom member, a parallelogram coupling unit including a bracket pivotally mounted on said common pivot unit and thereby to said tip boom member, a first leveler arm located parallel to said tip boom member and having one end pivotally connected to the coupling bracket and the second end pivotally connected to the support post to define with said tip boom member a first parallelogram linkage for locating of said support post, a second leveler arm located parallel to said lift arm and having a first end connected to said second vertical post and an opposite second end connected to said coupling bracket to define with said lift arm a second parallelogram linkage to continuously pivot said bracket and said vertical post for locating said support post in accordance with the angular positioning of said boom unit and said lift arm.

21. The apparatus of claim 20, wherein said motor means is a hydraulic piston and cylinder.

22. The apparatus of claim 20, wherein said base boom member and said tip boom member are tubular members having a common longitudinal axis, and said hydraulic piston and cylinder unit is mounted within said tubular members, first attachment unit connecting said piston to one of said tubular members, and second attachment unit connecting the cylinder to the other of said tubular members.

23. The apparatus of claim 21, wherein said lift arm includes a pair of laterally spaced rigid rod members located in parallel and laterally spaced relation, said rigid rod members being located one to each side of said boom unit, said second leveler arm includes a pair of laterally spaced rigid rod members located in spaced vertical alignment with said first named rigid rod members, said boom unit being collapsible into said lift unit and between said first and second named rigid rod members.

24. The apparatus of claim 22, wherein said bracket includes similar coupling plates, pivot units in said coupling plate and located to the opposite sides of said tip boom unit and rigid means connecting said coupling plates for identical pivoting, said first leveler arm includes rigid members being connected to each other and located between and pivotally connected to said coupling plates, and said second leveler rigid rod members located to the outside of said coupling plates and pivotally connected to said coupling plates, and link members pivotally secured to said pivot units and to said pivotal connection of said second leveler rigid rod members.

* * * * *

UNITED STATES PATENT AND TRADEMARK OFFICE

CERTIFICATE OF CORRECTION

PATENT NO. : 5,135,074

DATED : August 4, 1992

INVENTOR(S) : JOHN T. HORNAGOLD

It is certified that error appears in the above-indentified patent and that said Letters Patent is hereby corrected as shown below:

Claim 1, col. 14, lines 13-16 should read --pivot force on said linkage unit with the extension of said tip boom whereby said boom unit and said lift linkage unit--.

Claim 2, Col.14, line 19, after "lift" insert ---linkage---; Claim 2, Col. 14, line 20, after "lift" insert ---linkage---; Claim 2, Col. 14, line 22, after "lift" insert ---linkage---; Claim 5, Col. 15, line 6, after "said" delete "leveler", after "boom" insert ---leveler---; Claim 7, col. 15, line 27, delete "is maintained" (second occurrence); Claim 8, Col. 15, line 29, delete "2." and substitute therefor ---7---;

UNITED STATES PATENT AND TRADEMARK OFFICE

CERTIFICATE OF CORRECTION

PATENT NO. : 5,135,074

DATED : August 4, 1992

INVENTOR(S) : JOHN T. HORNAGOLD

It is certified that error appears in the above-identified patent and that said Letters Patent is hereby corrected as shown below:

Claim 12, Col. 16, line 17, delete "a"; Claim 14 Col. 16, line 32, cancel "a" and substitute therefor ---spaced---, cancel "member" (second occurrence) and substitute therefor ---members---; Claim 15, Col. 16, line 39, cancel "13" and substitute therefor ---14---; Claim 15, Col. 16, line 40, after "arm" insert ---unit---; Claim 16, Col. 16, line 45, cancel "13" and substitute therefor ---14---; Claim 20, Col. 17, line 7, after "boom" insert ---member---; Claim 20, Col. 17, line 26, after "and" (second occurrence) insert ---second---; Claim 20. Col. 17, line 32, before "bracket" insert ---coupling---.

Signed and Sealed this

Fourth Day of July, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,135,074

DATED : August 4, 1992

INVENTOR(S) : John T. Hornagold

It is certified that error appears in the above-identified patent and that said Letters Patent is hereby corrected as shown below:

Claim 1, Col. 14, line 2, after "unit" and before "," (comma) insert ---having an outer tip boom---; Claim 1, Col. 14, line 3, delete "." (period) after "base"; Claim 2, Col. 14, line 22, after "lift" insert ---linkage---; Claim 3, Col. 14, line 32, after " support" delete "-" (dash); Claim 4, Col. 14, line 38, delete "." (period) after "leveling"; Claim 7, Col. 15, line 27, delete "is maintained" (both occurrences); Claim 8, Col. 15, line 29, delete "." (period) after "2"; Claim 9, Col. 15, line 40, after "one" insert ---hundred---.

Signed and Sealed this

Sixteenth Day of January, 1996

*Attest:*

*Attesting Officer*

Bruce Lehman

BRUCE LEHMAN

*Commissioner of Patents and Trademarks*